US008092202B2

(12) United States Patent
Matlack

(10) Patent No.: US 8,092,202 B2
(45) Date of Patent: Jan. 10, 2012

(54) PROPELLER PUMP SYSTEM FOR HANDED PROPELLER APPLICATIONS

(75) Inventor: Floyd Kent Matlack, Granby, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1714 days.

(21) Appl. No.: 11/146,813

(22) Filed: Jun. 7, 2005

(65) Prior Publication Data

US 2006/0275117 A1 Dec. 7, 2006

(51) Int. Cl.

| | |
|---|---|
| ***F01C 1/18*** | (2006.01) |
| ***F01C 1/24*** | (2006.01) |
| ***F04C 2/18*** | (2006.01) |
| ***F04C 18/18*** | (2006.01) |

(52) U.S. Cl. ..... 418/206.1

(58) Field of Classification Search ..... 418/206.1
See application file for complete search history.

(56) References Cited

U.S. PATENT DOCUMENTS

| | | | | |
|---|---|---|---|---|
| 1,687,523 | A * | 10/1928 | Staude | 418/32 |
| 2,258,077 | A * | 10/1941 | Taylor | 184/6.12 |
| 2,571,377 | A | 10/1951 | Olah | |
| 2,606,498 | A * | 8/1952 | Witherell | 417/204 |
| 2,665,636 | A * | 1/1954 | Compton et al. | 418/39 |
| 3,059,584 | A | 10/1962 | Cottell | |
| 3,076,413 | A * | 2/1963 | Hoffer | 418/1 |
| 3,244,110 | A * | 4/1966 | Lee | 418/83 |
| 3,286,643 | A * | 11/1966 | Andrews et al. | 418/78 |
| 4,480,970 | A * | 11/1984 | Smith | 418/15 |
| 6,200,117 | B1 * | 3/2001 | Brown | 418/206.6 |
| 6,716,011 | B2 * | 4/2004 | Bhagavatula | 418/206.1 |
| 6,979,185 | B2 * | 12/2005 | Kaempe | 418/131 |
| 6,991,442 | B2 * | 1/2006 | Meguro | 418/182 |
| 7,124,662 | B2 * | 10/2006 | Santerre | 74/665 H |
| 7,150,612 | B2 * | 12/2006 | Komatsu et al. | 418/206.1 |
| 2002/0127126 | A1 * | 9/2002 | Kaempe | 418/206.1 |
| 2005/0022381 | A1 | 2/2005 | Meguro | |

FOREIGN PATENT DOCUMENTS

| | | |
|---|---|---|
| FR | 2119294 | 8/1972 |
| GB | 526260 | 9/1940 |
| WO | 8101315 | 5/1981 |

OTHER PUBLICATIONS

European Search Report dated Apr. 1, 2010.

* cited by examiner

*Primary Examiner* — Thomas Denion
*Assistant Examiner* — Mary A Davis
(74) *Attorney, Agent, or Firm* — Carlson Gaskey & Olds, P.C.

(57) ABSTRACT

A pump system includes an inlet port, a discharge port, a drive aperture and a drain aperture. The drive aperture and the drain aperture are interchangeable such that the pump system may be utilized on either a clockwise or counterclockwise driven propeller. A propeller gearbox driven pump drive shaft is mounted into either aperture such that the aperture which receives the drive shaft becomes the drive aperture while the other aperture becomes the drain aperture. By allowing either pumping gear to become the driver gear by receiving the drive shaft, the pump system may accommodate either a clockwise or counterclockwise propeller gearbox.

22 Claims, 5 Drawing Sheets

PROPELLER PUMP SYSTEM FOR HANDED PROPELLER APPLICATIONS

BACKGROUND OF THE INVENTION

The present invention relates to a pump system, and more particularly to a pump system which may be interchangeably utilized for either a clockwise or counterclockwise propeller shaft rotation.

Multi-engine propeller aircraft utilize pump systems which are driven by a propeller system gearbox. Typically, a pump system is mounted to a bulkhead within an engine nacelle of each engine to locate the main pump in proximity to the propeller system and associated gearbox. On multi-engine propeller aircraft, the propeller on adjacent engines typically rotates in opposite direction to counteract torque. That is, the propeller system of engine one rotates clockwise, the propeller system of engine two rotates counterclockwise, the propeller system of engine three rotates clockwise, and the propeller system of engine four rotates counterclockwise. Although an advantage from a propulsion perspective, such alternating rotations complicate pump installations as the engine gearboxes are also rotating in opposite directions. The associated pump drive systems must accommodate these specific rotations.

Conventional pump systems include a male drive shaft that extends from the pump system. Such conventional pump systems are designed to be driven from either end by switching the shaft. That is, a mounting structure is located on one end of the pump and a relatively significant blanking plate is bolted to the unused end to close the unused end of the pump against full pump pressure. This permits any single pump to accommodate either a clockwise or counterclockwise driven propeller system.

Disadvantageously, such conventional pump systems require that a clockwise mounting plate, a counterclockwise mounting plate and blanking plate be carried on the pump system at all times which increases system weight. The male drive shaft must also be removed and replaced to the opposite side to change the pump system to an opposite propeller rotation position. Such changeover requires disassembly of the pump at a significant depot level maintenance facilities which may increase aircraft downtime. The changeover to assure proper drive direction is a relatively complicated procedure which may further complicates maintenance time and expense.

Accordingly, it is desirable to provide a lightweight engine driven pump system which accommodates either a clockwise or counterclockwise propeller shaft rotation.

SUMMARY OF THE INVENTION

A pump system according to the present invention includes an inlet port, a discharge port, a drive aperture and a drain aperture. The drive aperture and the drain aperture are interchangeable such that the pump system may be utilized on either a clockwise or counterclockwise driven propeller. A gearbox driven male pump drive shaft is mounted into either aperture such that the aperture which receives the drive shaft becomes the drive aperture while the other aperture becomes the drain aperture.

A first pump gear is the driver gear in meshing engagement with a second pump gear which is the driven gear. The pump gears each include external gears in meshing engagement which communicate the fluid around the outside of the gears to provide the fluid pumping action from the inlet port to the discharge port. Fluid which is not communicated to the discharge port eventually collects within the second pump gear and is communicated to a gearbox drain through the drain aperture. As either pumping gear may become the driver gear by receiving the male drive shaft, the pump system may accommodate either a clockwise or counterclockwise propeller gearbox.

The present invention therefore provides a lightweight engine driven pump system which accommodates either a clockwise or counterclockwise propeller shaft rotation.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
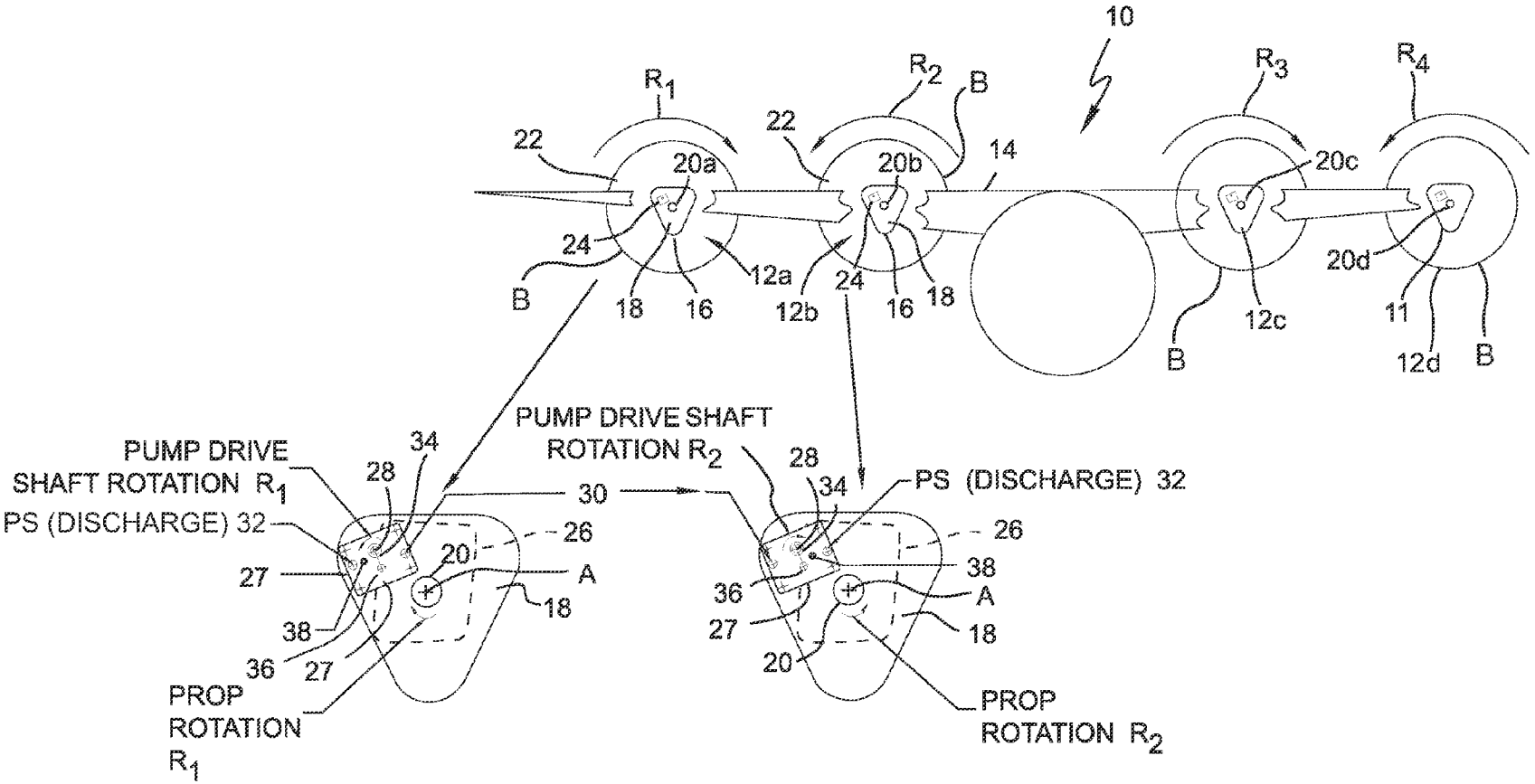
FIG. 1 is a general rear schematic view of a multi-engine aircraft for use with the present invention.

FIG. 1 illustrates a general schematic rear view of a multi-engine aircraft 10. The aircraft 10 includes a multiple of engines 12 each mounted to an aircraft wing 14. Each engine 12 is typically contained within an engine nacelle 16 having a bulkhead 18 through which passes a propeller shaft 20 to drive a propeller system 22 having a multiple of propeller blades B about an axis of rotation A.

A pump system 24 (FIG. 2) is mounted to each bulkhead 18 within the nacelle 16 of each engine 12. The pump system 24 is driven by a propeller gearbox 26 (illustrated schematically). On multi-engine prop aircraft, the propeller system 22 on adjacent engines 12 typically rotate in opposite direction (illustrated by arrow R) to counteract torque. That is, the propeller shaft 20*a* of engine one 12*a* rotates clockwise, the propeller shaft 20*b* of engine two 12*b* rotates counterclockwise, the propeller shaft 20*c* engine three 12*c* rotates clockwise and the propeller shaft 20*d* of engine four 12*d* rotates counterclockwise as respectively driven by the gearbox 26.

Such an alternating propeller rotation scheme requires that each associated pump system 24 be driven in a direction commensurate therewith. A mounting pad 27 is attached to each bulkhead 18 to mount the pump system 24 such that a pump drive shaft 28 rotates in a rotational direction (illustrated schematically by arrow r) relative to the propeller shaft 20 rotational direction R. The pump drive shaft 28 is preferably a male splined shaft. Typically, the pump shaft 28 rotates opposite the propeller shaft 20, however, other rotational schemes are also usable with the present invention. The male pump drive shaft 28 extends through the mounting pad 27 and is driven by the propeller gearbox 26 to drive the pump system 24.

Figure 2:
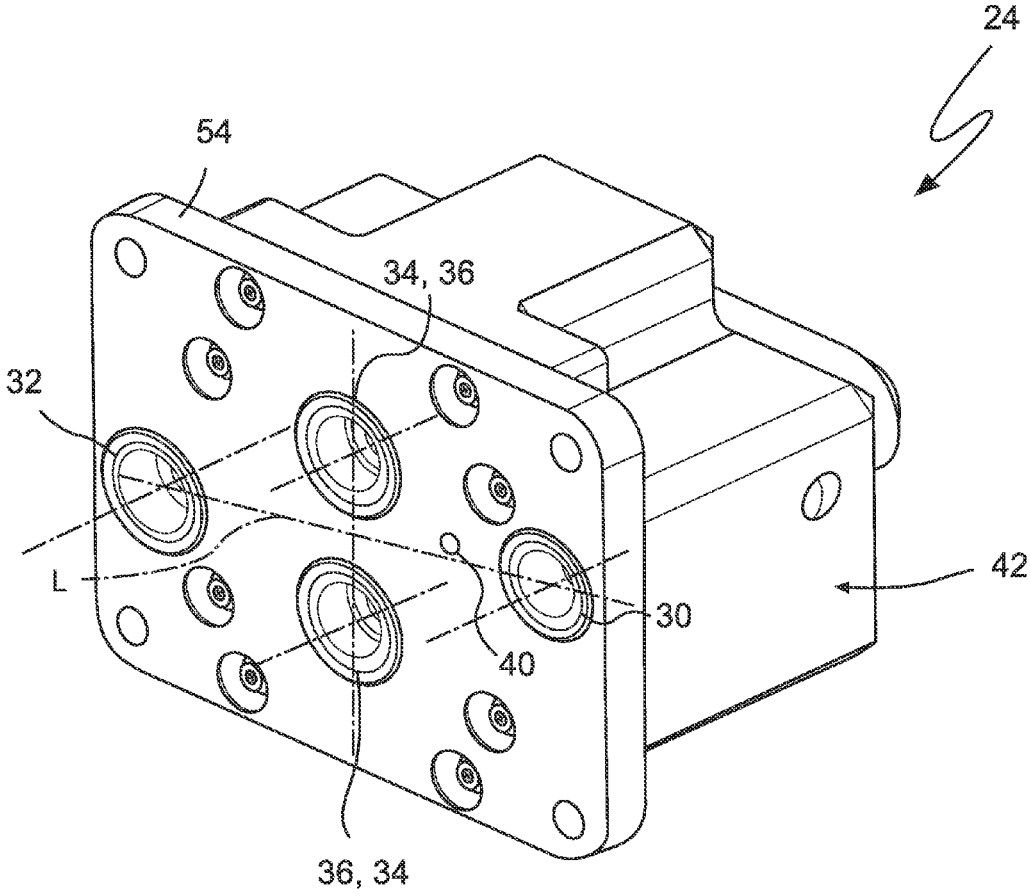
FIG. 2 is a perspective view of a pump system of the present invention.

The pump system 24 includes an inlet port 30, a discharge port 32, a drive aperture 34 and a drain aperture 36 (FIG. 2). Notably, the drive aperture 34 and the drain aperture 36 are interchangeable such that the pump system 24 may be utilized on either a clockwise or counterclockwise driven propeller.

That is, the male pump drive shaft 28 is mounted into either aperture 34, 36. Whichever aperture 34, 36 the drive shaft 28 is installed into becomes the drive aperture 34 while the other aperture 36, 34 becomes the drain aperture 36.

Preferably, a locator pin 38 extends from the mounting pad 27 and is received into a locating aperture 40 formed into a seal plate 54 of pump housing 42 (FIG. 2). Notably, the locating pin 38 is in opposite positions on the mounting pad 27 depending upon whether the propeller system is clockwise or counterclockwise driven to assure proper mounting of the pump system 24. The locating aperture 40 is in only a single position on the pump system 24 (FIG. 2) to assure that fluid is pumped from the inlet port 30 to the discharge port 32 irrespective of which handed propeller gearbox the pump system 24 is mounted to.

The inlet port 30 and the discharge port 32 are preferably located opposite each other and are spaced generally horizontally relative the vertically mounted apertures 34, 36. Such arrangement permits the drain aperture 36 to always be at the lowest point when the pump system 24 is mounted to the aircraft (FIG. 1). It should be understood that relative positional terms such as "forward," "aft," "upper," "lower," "above," "below," "horizontal," "vertical," and the like are with reference to the normal operational attitude of the vehicle and should not be considered otherwise limiting.

Figure 3:
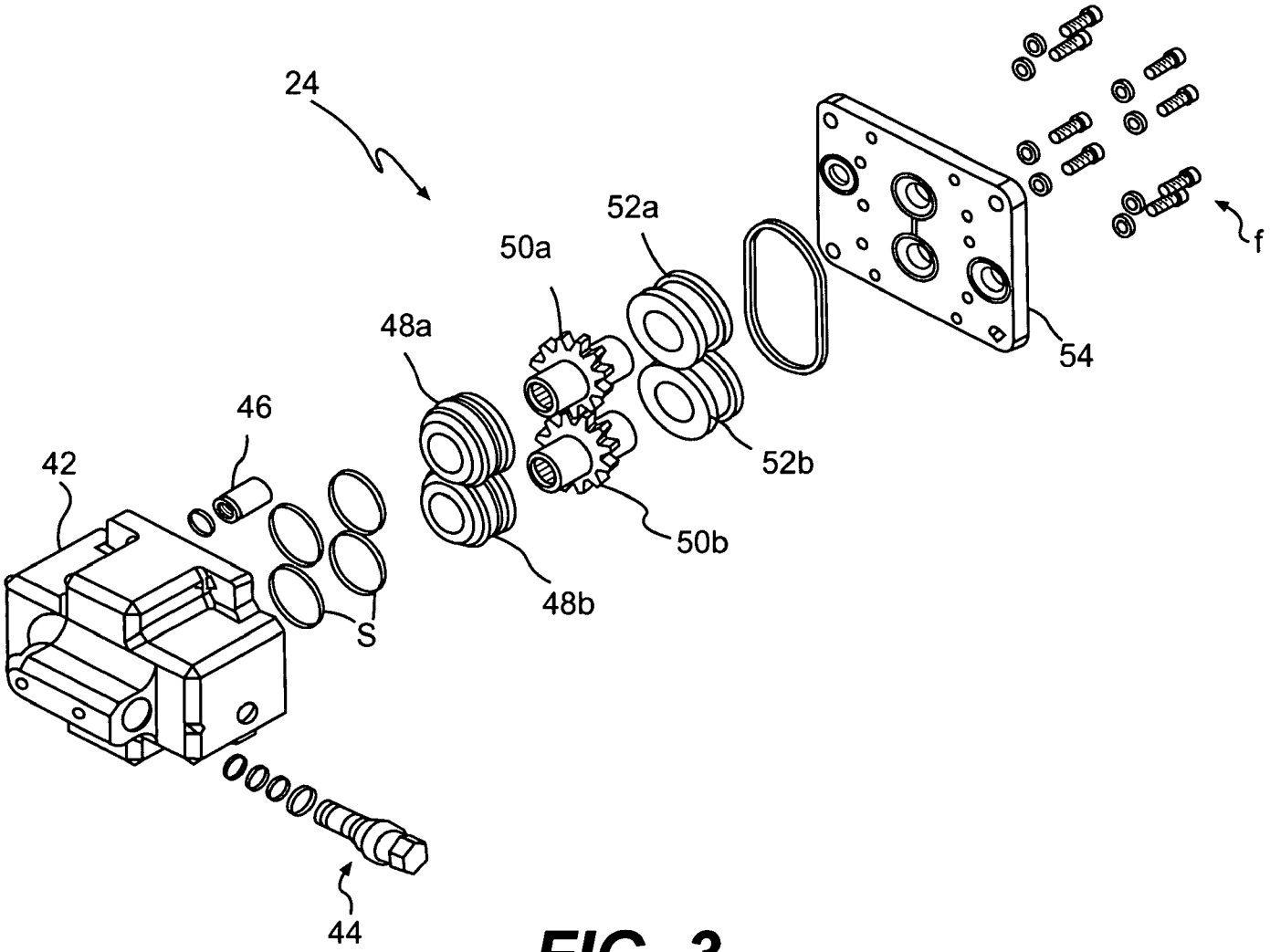
FIG. 3 is an exploded view of a pump system of the present invention.

Referring to FIG. 3, the pump system 24 generally includes the pump housing 42, a relief valve assembly 44, a discharge check valve assembly 46, a first and second floating bearing 48*a*, 48*b*, a first and second pump gear 50*a*, 50*b*, a first and second fixed bearing 52*a*, 52*b* and a seal plate 54. A multitude of seals S assure a fluid seal between the rotating components when the seal plate 54 is fastened to the pump housing 42 by a multitude of fasteners f.

Figure 4:
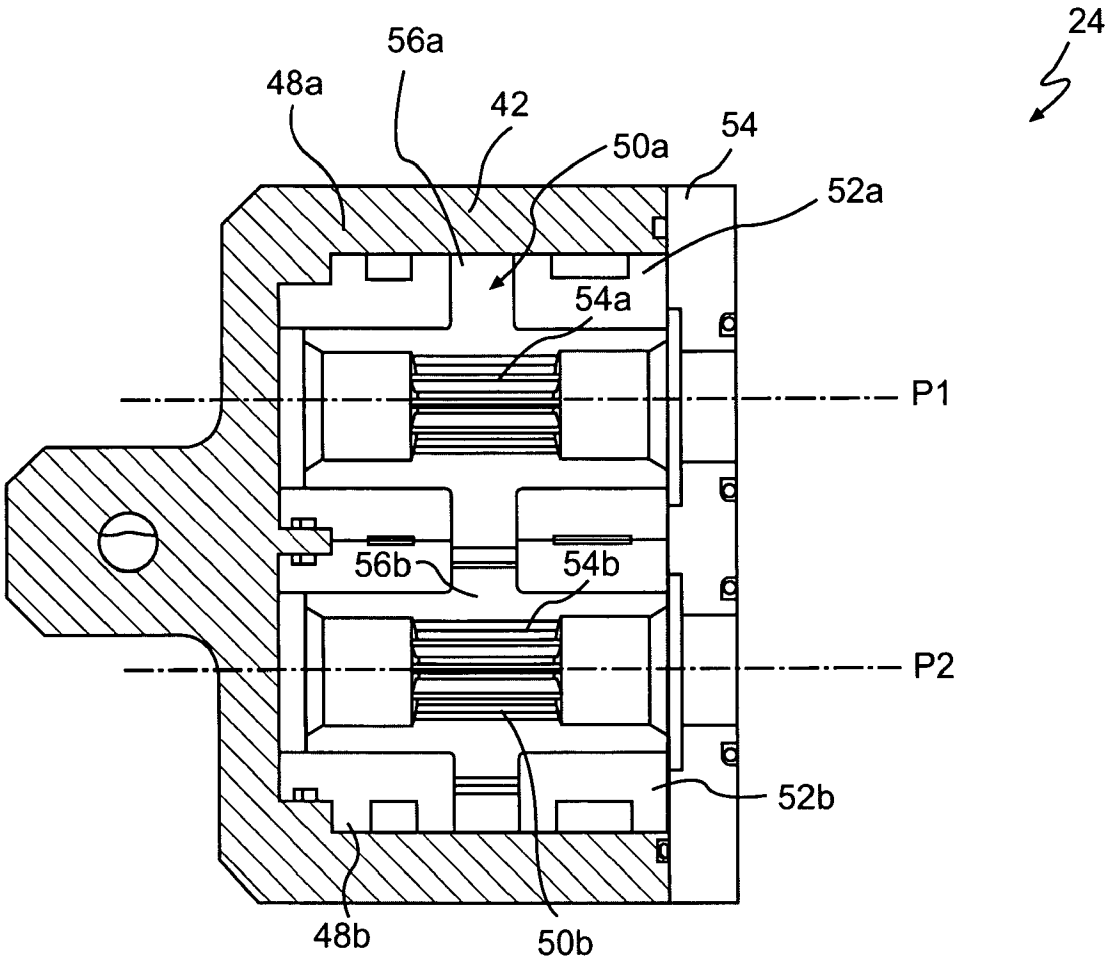
FIG. 4 is a sectional view of the pump system taken along line 4-4 in FIG. 2.

Referring to FIG. 4, the first pump gear 50*a*, the first floating bearing 48*a* and the first fixed bearing 52*a* defines a gear system along a first axis of rotation $P_1$. The second pump gear 50*b*, the second floating bearing 48*b* and the second fixed bearing 52*b* defines a gear system along a second axis of rotation $P_2$. The axes of rotation are $P_1$ and $P_2$ are parallel and generally transverse to a line L between the inlet port 30 and discharge port 32 (FIG. 2).

Figure 5:
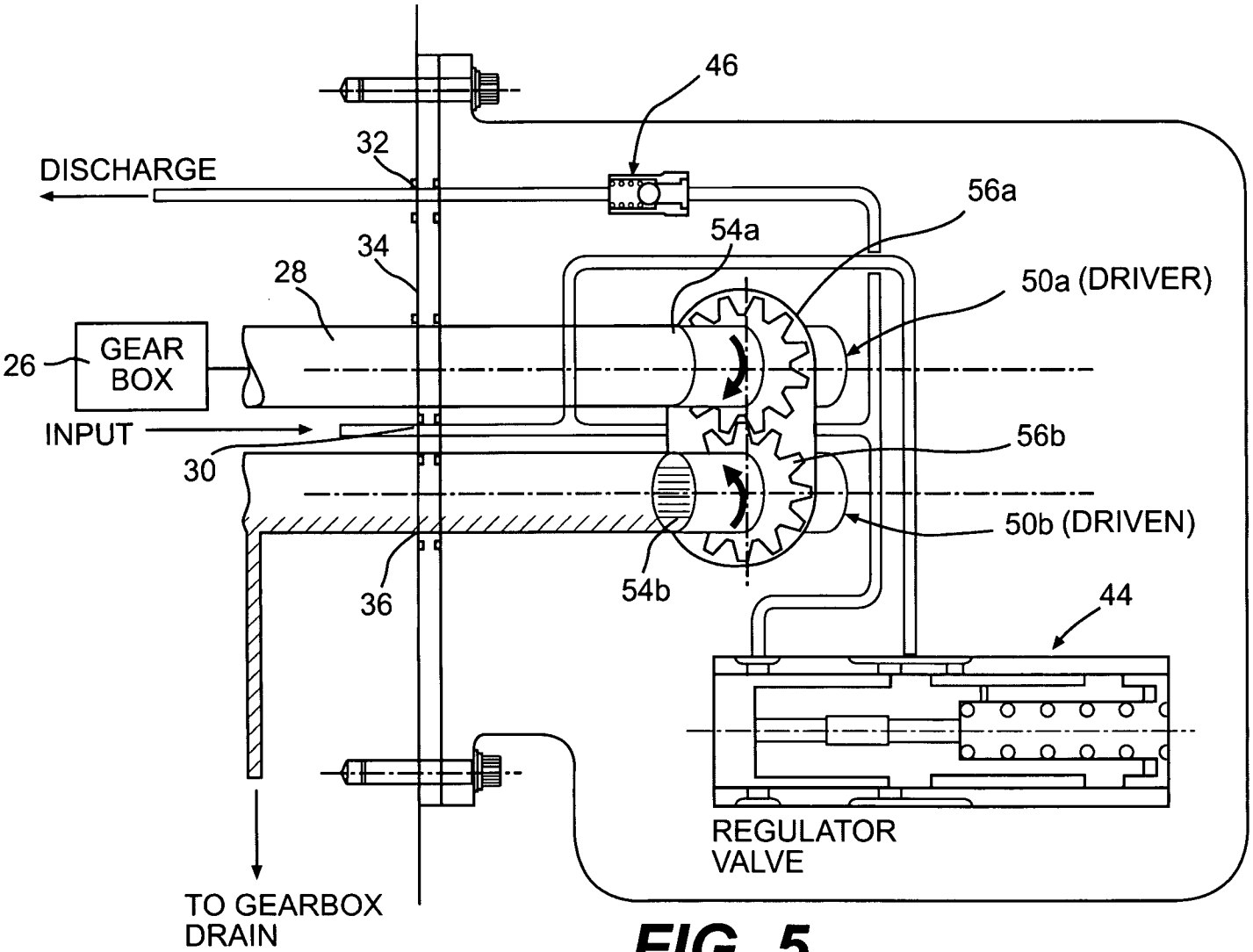
FIG. 5 is a schematic view of fluid flow through the pump system of the present invention.

The first and second pump gear 50*a*, 50*b* each include an internal female spline 54*a*, 54*b* and an external gear 56*a*, 56*b*. The internal female spline 54*a*, 54*b* are equivalent and splined to receive the drive shaft 28 (FIG. 5). The drive shaft 28 extends from the propeller gearbox 26 (FIG. 5) and is pressed into the appropriate internal female spline 54*a*, 54*b* depending upon whether the gearbox is of clockwise or counterclockwise rotation. Such installation may be accomplished at a field level environment.

Either internal female spline 54*a*, 54*b* interchangeably receive the drive shaft 28 such that when the first internal female spline 54*a* receives the drive shaft 28, the first pump gear 50*a* is the driver gear, the first internal female spline 54*a* becomes the drive aperture 34, and the second internal female spline 54*b* becomes the drain aperture 36. Alternatively, when the second internal female spline 54*b* receives the drive shaft 28, the second pump gear 50*b* is the driver gear, the second internal female spline 54*b* becomes the drive aperture 34, and the first internal female spline 54*a* becomes the drain aperture 36.

Referring to FIG. 5, the first pump gear 50*a* is the driver gear in meshing engagement with the second pump gear 50*b* which is the driven gear. The external gears 56*a*, 56*b* communicate the fluid around the outside of the gears 50*a*, 50*b* to provide the fluid pumping action from the inlet port 30 to the discharge port 32. The gear mesh operates as a seal. Fluid which is not communicated to the discharge port 32 eventually collects within and around the second pump gear 50*b* and is communicated to a gearbox drain through the internal female spline 54*a* and the drain aperture 36.

It should be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A pump system comprising:

a pump housing;

a seal plate mountable to said pump housing;

a first gear system contained at least partially within said pump housing;

a second gear system contained at least partially within said pump housing, said second gear system in meshing engagement with said first gear system to pump a fluid from a pump inlet through said seal plate to a pump discharge through said seal plate, said first gear system includes a first internal female spline and said second gear system includes a second internal female spline, wherein one of said first female spline and said second female spline provides communication between the fluid to be pumped in said pump housing with a drain aperture in said seal plate, the other of said first gear system and said second gear system in communication with a drive aperture through said seal plate.

2. The pump system as recited in claim 1, further comprising a shaft located through said drive aperture and engageable with the other of said first gear system and said second gear system.

3. The pump system as recited in claim 1, wherein said first gear system includes a first external gear and said first internal female spline and said second gear system includes a second external gear and said second internal female spline, said first external gear in meshing engagement with said second external gear, said first internal female spline in communication with a drive aperture and said second internal female spline in communication with said drain aperture.

4. The pump system as recited in claim 3, wherein said first female spline communicates with a pump drain.

5. The pump system as recited in claim 3, further comprising a male shaft receivable in the other of said first female spline and said second female spline not in communication with said drain aperture.

6. The pump system as recited in claim 3, wherein said first external gear is coaxial with said first internal female spline and said second external gear is coaxial with said second internal female spline.

7. The pump system as recited in claim 3, wherein said first external gear and said second external gear pump a fluid about an outer periphery thereof.

8. The pump system as recited in claim 1, wherein said first gear system rotates about a first axis and said second gear system rotates about a second axis parallel to said first axis.

9. The pump system as recited in claim 8, wherein a line connecting said pump inlet and said pump discharge is transverse to said first and second axis.

10. The pump system as recited in claim 1, further comprising a pump mounting pad having a locating feature which extends therefrom, said locating feature engageable with said pump system to orient said pump system relative a propeller rotational direction.

11. The pump system as recited in claim 1, wherein a line defined between said pump inlet and said pump discharge is transverse to a line defined between said drive aperture and said drain aperture.

12. The pump system as recited in claim 1, wherein said seal plate is a substantially planar member.

13. A propeller system comprising:

a pump mounting pad for a propeller system driven in a propeller rotational direction;

a shaft which extends though said pump mounting pad, said shaft driven in a shaft rotational direction relative to the propeller rotational direction of the propeller system; and a pump system mounted to said pump mounting pad, said pump system comprising:

a pump housing;

a seal plate mountable to said pump housing and said pump mounting pad;

a first gear system having a first female spline, said first gear system contained at least partially with said pump housing; and a second gear system contained at least partially within said pump housing, said second gear system in meshing engagement with said first gear system to pump a fluid from a pump inlet through said seal plate to a pump discharge through said seal plate, said second gear system having a second female spline, said shaft receivable through a drive aperture through said seal plate into one of said first female spline or said second female spline depending on the rotational direction of the propeller system, the other of said first female spline and said second female spline provides communication between the fluid to be pumped in said pump housing with a drain aperture through said seal plate.

14. The propeller system as recited in claim 13, wherein said pump mounting pad includes a locating feature which engages said pump system to rotationally orient said pump system such that said male shaft is receivable in said one of said first female spline or said second female spline in response to the rotational direction of the propeller system.

15. The propeller system as recited in claim 13, wherein said drain aperture is located below said shaft relative a rotational axis of the propeller system.

16. The propeller system as recited in claim 13, wherein a line defined between said pump inlet and said pump discharge is transverse to a line defined between said drive aperture and said drain aperture.

17. The propeller system as recited in claim 13, wherein said propeller system includes a multiple of propeller blades.

18. A method of mounting a pump system to either a clockwise or counterclockwise rotating drive system comprising the steps of:

(1) driving a shaft in a rotational direction related to a rotational direction of a rotating drive system;

(2) engaging the shaft with one of a first and second gear system through a drive aperture through a seal plate of a pump system depending on the rotational direction of the rotational drive system, the first and second gear system in meshing engagement such that the first and second gear system pumps a fluid from a pump inlet through the seal plate to a pump discharge through the seal plate; and (3) draining fluid to be pumped from the pump housing through a first internal spline in the other of said first and second gear systems and then through a drain aperture in the seal plate.

19. A method as recited in claim 18, wherein said step (1) further comprises:

(a) driving the shaft with a propeller gearbox.

20. A method as recited in claim 18, wherein said step (2) further comprises:

(a) engaging the shaft with a second internal spline of the one of the first and second gear systems.

21. A method as recited in claim 18, further comprising the steps of:

(3) orienting the pump system with respect to the rotational direction of the rotating system.

22. A method as recited in claim 18, further comprising the steps of:

(3) orienting the pump system with respect to the rotational direction of a propeller system.

* * * * *